US006702040B1

(12) United States Patent
Sensenig

(10) Patent No.: US 6,702,040 B1
(45) Date of Patent: Mar. 9, 2004

(54) TELESCOPIC DRILLING METHOD

(76) Inventor: Floyd R. Sensenig, 510 Fivepointville Rd., Denver, PA (US) 17517

( * ) Notice: Subject to any disclaimer, the term of this patent is extended or adjusted under 35 U.S.C. 154(b) by 52 days.

(21) Appl. No.: 10/132,077

(22) Filed: Apr. 25, 2002

Related U.S. Application Data

(60) Provisional application No. 60/286,498, filed on Apr. 26, 2001.

(51) Int. Cl.[7] ..... E21B 7/26

(52) U.S. Cl. ..... 175/23; 175/57; 175/306; 175/321; 175/385

(58) Field of Search ..... 175/57, 19, 21–23, 175/306, 305, 321, 322, 385, 386, 298

(56) References Cited

U.S. PATENT DOCUMENTS 5,839,519 A * 11/1998 Spedale, Jr. ..... 175/57

FOREIGN PATENT DOCUMENTS

JP 402296989 A * 12/1990
JP 404124395 A * 4/1992

* cited by examiner

*Primary Examiner*—Zakiya Walker
(74) *Attorney, Agent, or Firm*—Webb Ziesenheim Logsdon Orkin & Hanson, P.C.

(57) ABSTRACT

A telescopic drilling method includes the steps of drilling an outer bore through a surface, inserting a hollow outer conduit into the outer bore, and at least partially inserting a first hollow inner conduit through the outer conduit. Next, the method includes the steps of preventing the first inner conduit from moving longitudinal with respect to the outer conduit engaging a rotatable inner drill bit with a ring drill bit and further drilling the outer bore using a unitary drill bit head to a successive depth. The inner drill bit is disengaged from the ring drill bit and a second end of a successive hollow inner conduit is attached to a first end of a preceding one, and the preceding inner conduit is unclamped.

20 Claims, 7 Drawing Sheets

TELESCOPIC DRILLING METHOD

CROSS-REFERENCE TO RELATED APPLICATIONS

This application claims the benefit of U.S. Provisional Application Ser. No. 60/286,498, filed Apr. 26, 2001.

BACKGROUND OF THE INVENTION

1. Field of the Invention

The present invention relates generally to drilling methods, and, in particular, to telescopic drilling methods for use in connection with overburden drilling operations.

2. Description of Related Art

In order to collect and transfer water, wells are used and created by drilling a well hole or bore into the ground to an aquifer or water layer. As these bores are being drilled, often an overburden layer or rock layer is encountered and must be breached prior to reaching the water layer. In addition, the water layer often is far underground and requires special machinery and drilling equipment to reach.

Prior art drilling systems use long conduits, referred to as casings, welded together and gradually moved down the bore as it is drilled. However, the drilling operation creates stress on the casings and weld joints and may cause these casings to fracture. Such drilling impact and vibration stress is sustained by the rigid one-piece drill casing and its weld joints, causing cracks and fractures, which typically require the hole or bore to be cleared and the drilling process recommenced only after time and material expenditures.

Further, the present drilling methods are slow, as the drill is required to pull the entire casing length along with it as it penetrates further into the earth. This process is further slowed since the casing being pulled by the drill may be experiencing friction, pressure and contortions as a result of the outer walls of the bore collapsing and overburdened filling in against the casing. These deficiencies, exhibited by the prior art drills and the prior art drilling methods, decrease the drilling process efficiency and increases the "wear and tear" on the drilling machinery.

As the bores are often deep, the prior art drilling methods also require large and extended lengths of casings to be attached together, which causes the casing segments to stand high over the work area, and the drill rod segment must be loaded within the next casing section before it is transported and erected above the bore for welding to the preceding section. Such transport of the next casing segment containing the next drill rod segment is often precarious and results in human injury.

Present drilling methods require that the drilling by product and debris be expelled and managed high above ground level, with the use of a converter system which caps the top of the next casing section as it moves toward ground level during each drilling segment. Typically, a long overhead hose carries the debris from this converter system. However, this converter system must be removed and replaced for each drilling segment. Further, this converter system also stands high over the work site and poses an overhead hazard. In addition, there remains the possibility that the hose may entangle a person or machinery, and this overall converter system is complex and causes unnecessary delays in the drilling process.

Accordingly, it is an object of the present invention to provide a telescopic drilling method that overcomes these and other deficiencies in prior art drilling methods.

SUMMARY OF THE INVENTION

The present invention is a telescopic drilling method, and includes the steps of: (a) drilling an outer bore through a surface, the outer bore defined by an outer bore wall and an outer bore base and having an outer bore diameter and a first outer bore depth; (b) inserting a hollow outer conduit into the outer bore, the outer conduit having a drill end with a ring drill bit rotatably attached thereto; (c) at least partially inserting a first hollow inner conduit through the outer conduit; (d) preventing the first inner conduit from moving longitudinally with respect to the outer conduit; (e) engaging a rotatable inner drill bit with the ring drill bit, thereby creating a unitary drill bit head; (f) further drilling the outer bore using the unitary drill bit head to a successive outer bore depth; and (g) disengaging the inner drill bit from the ring drill bit, such that the outer conduit is capable of moving freely within the outer bore.

In the preferred embodiment, a second end of a successive hollow inner conduit is attached to a first end of an immediately preceding inner conduit, thereby creating an extended inner conduit, which is able to reach greater depths under the surface. The telescopic drilling method of the present invention is particularly useful in connection with overburden or rock drilling.

The present invention, both as to its construction and its method of operation, together with the additional objects and advantages thereof, will best be understood from the following description of exemplary embodiments when read in connection with the accompanying drawings.

BRIEF DESCRIPTION OF THE DRAWINGS

FIG. 5(*b*) is a front view of a unitary drill bit head of the drilling apparatus of FIG. 2 according to the present invention;

DETAILED DESCRIPTION OF THE PREFERRED EMBODIMENTS

Figure 1:
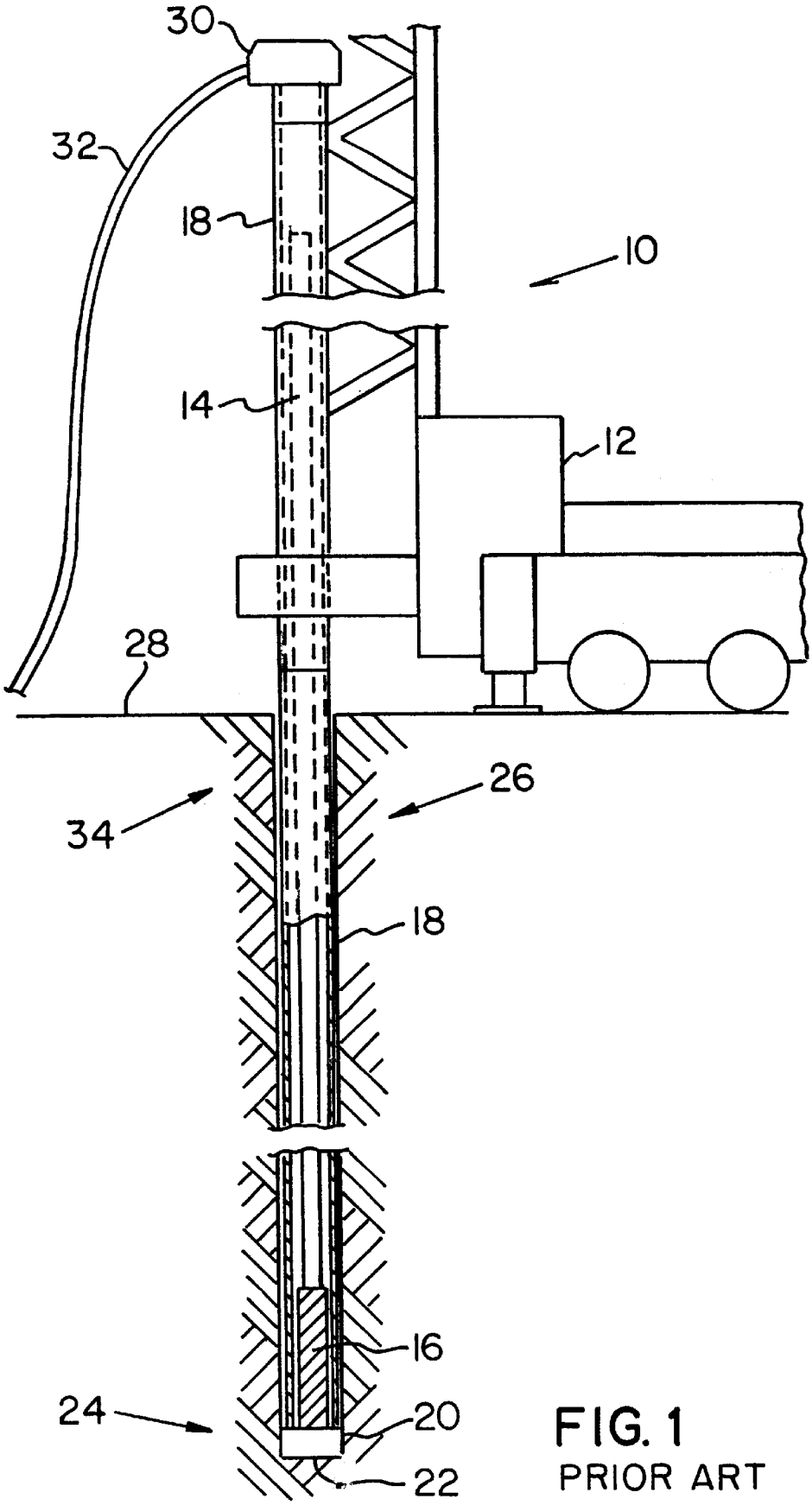
FIG. 1 PRIOR ART
FIG. 1 is a side schematic sectional view of a drilling method and apparatus according to the prior art.

FIG. 1 illustrates a drilling apparatus 10 and method according to the prior art. A typical drilling apparatus includes a drilling machine 12, which rotates a drill rod 14 having a drill hammer 16 attached thereto. The drill rod 14 and drill hammer 16 extend through a casing section 18. A ring drill bit 20 is attached to the casing section 18 and has a tubular construction. A pilot drill bit 22 is engaged with the ring drill bit 20, thereby creating a unitary drill bit head 24. It is this unitary drill bit head 24 that the drilling machine 12 uses to drill a bore 26 through a surface 28, typically the surface of the earth.

As the unitary drill bit head 24 penetrates further below the surface 28 and increases the depth of the bore 26, byproduct and debris (not shown), typically referred to as shavings, are expelled from the bore 26 through the casing section 18. The shavings move up the casing section 18 and encounter a cap 30, which directs the shavings through a tube 32 to a pile on the surface 28.

As the drilling machine 12 drills the bore 26 deeper, the unitary drill bit head 24 pulls the casing section 18 further below the surface 28. This prior art drilling method uses successive lengths of equal-diameter casing sections 18 routed directly to the upper end of the immediately preceding casing 18 section. This creates a unitary drill casing 34. It is this unitary drill casing 34 that is pulled further into the bore 26, as the drilling process continues, and, further, it is this drill casing 34 that sustains and absorbs substantial drilling impact and vibration stress. The prior art drilling method also requires that each successive welded casing section 18 remain above the surface 28 during the drilling process. Therefore, the next casing section 18 must be welded or attached to the lower or previous casing section 18 prior to its entry into the bore 26. In addition, each successive casing section 18 must be "loaded" with another section of the drill rod 14 before it is transported and erected over the bore 26 and before the casing section 18 is welded to the preceding casing section 18. Further, the cap 30 must be reinstalled at the top of each new casing section 18.

Figure 2:
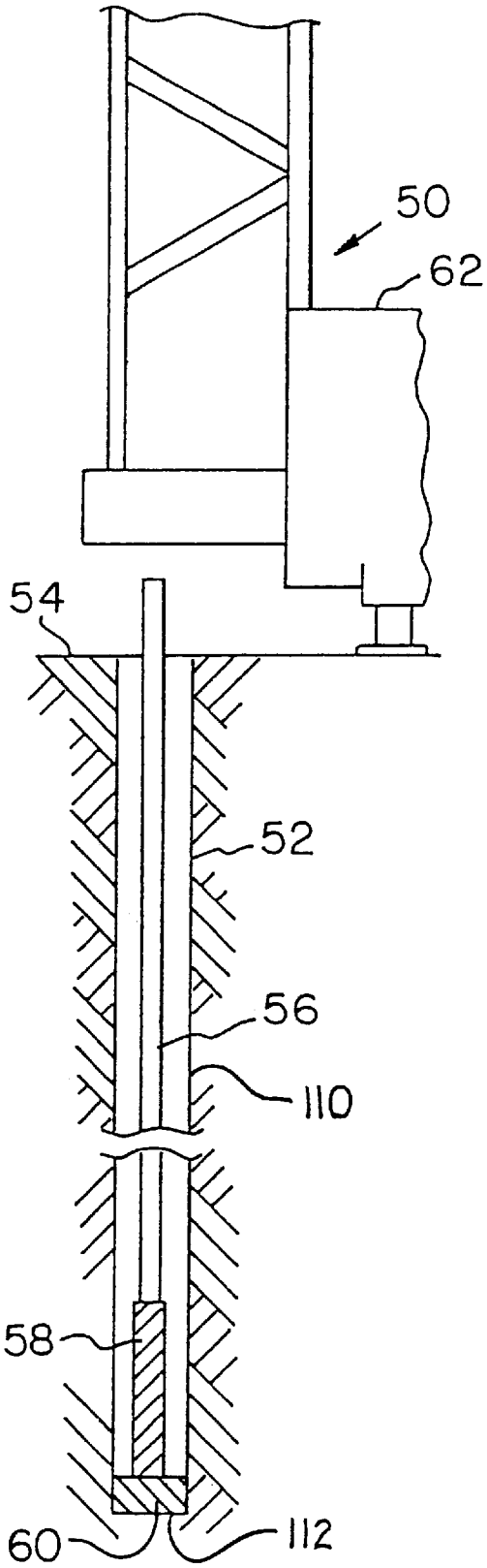
FIG. 2 is a side schematic sectional view of a drilling apparatus performing a step of a preferred embodiment of the telescopic drilling method according to the present invention.
Figure 3:
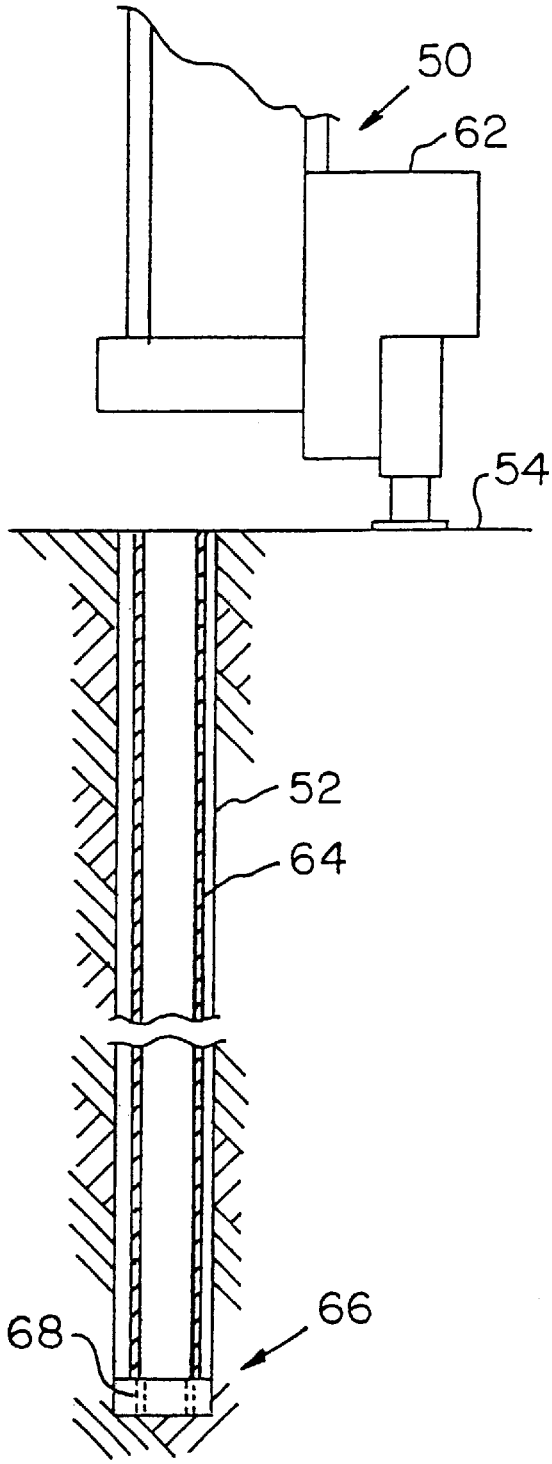
FIG. 3 is a side schematic view of the drilling apparatus of FIG. 2 performing a further step of a preferred embodiment of the telescopic drilling method according to the present invention.

The present invention is directed to a telescopic drilling method, and a drilling apparatus 50 engaged in a preferred embodiment of this method is illustrated in FIGS. 2–11. First, as seen in FIG. 2, an outer bore 52 is drilled through a surface 54, and the outer bore 52 extends below the surface 54. The outer bore 52 is defined by an outer bore wall 110 and an outer bore base 112. In order to drill this outer bore 52, the drilling apparatus 50 includes a drill rod 56 with a drill hammer 58 attached thereto. A rotatable drill bit 60 is attached to the drill hammer 58, and all of the drill rod 56, drill hammer 58 and drill bit 60 are rotated by a drilling machine 62. See FIG. 2. The drill rod 56, drill hammer 58 and drill bit 60 are removed from the outer bore 52. Next, a hollow outer conduit 64 is inserted into the outer bore 52, and the outer conduit 64 has an outer conduit drill end 66 with a ring drill bit 68 attached thereto. This ring drill bit 68 is able to rotate independently of the outer conduit 64. See FIG. 3.

Figure 4:
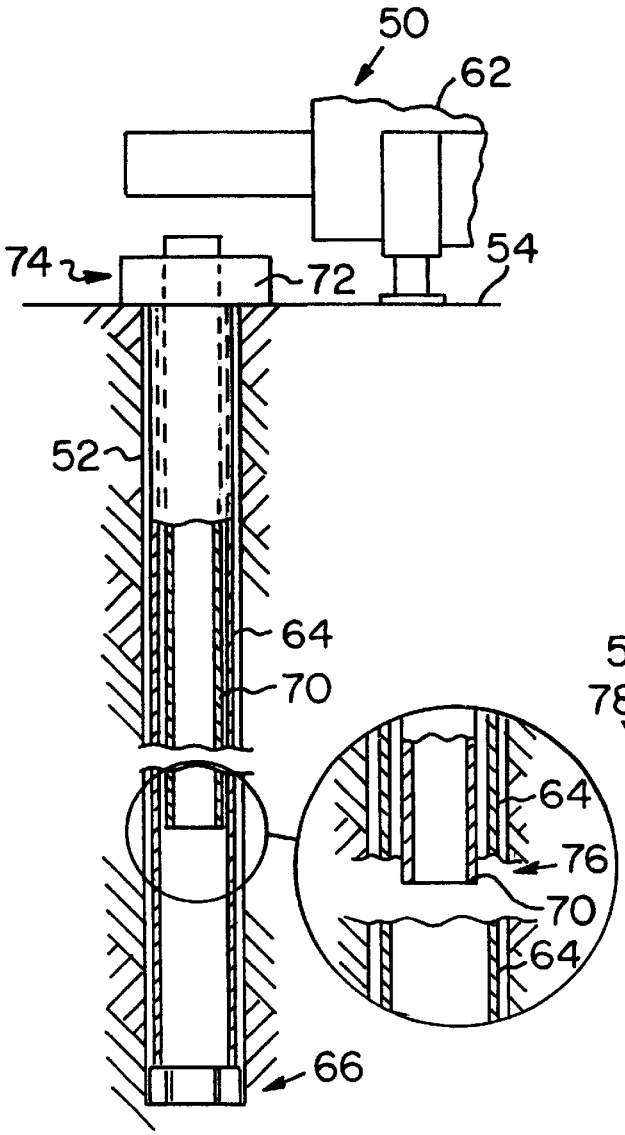
FIG. 4 is a side schematic sectional view of the drilling apparatus of FIG. 2 performing a further step of a preferred embodiment of the telescopic drilling method according to the present invention.

A first hollow inner conduit 70 is inserted into the outer conduit 64 and extends a portion of the length of the outer conduit 64. As seen in FIG. 4, a clamping mechanism 72 clamps the first inner conduit 70 at or near the surface 54, such that the first inner conduit 70 cannot move longitudinally within the outer conduit 64. The first inner conduit 70 has a first inner conduit first end 74 and a first inner conduit second end 76, and the clamping mechanism 72 holds the first inner conduit 70, such that the first inner conduit first end 74 is in an exposed and accessible position. Further, the first inner conduit 70 is sized such that it is slidable within the outer conduit 64.

Figure 5B:
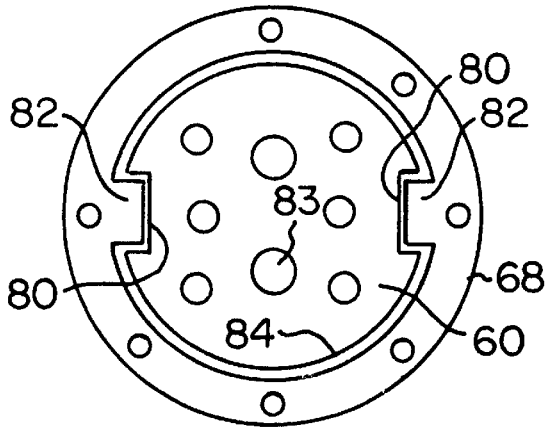
FIG. 5(*a*) is a side schematic sectional view of the drilling apparatus of FIG. 2 performing a further step of a preferred embodiment of the telescopic drilling method according to the present invention.
Figure 5A:
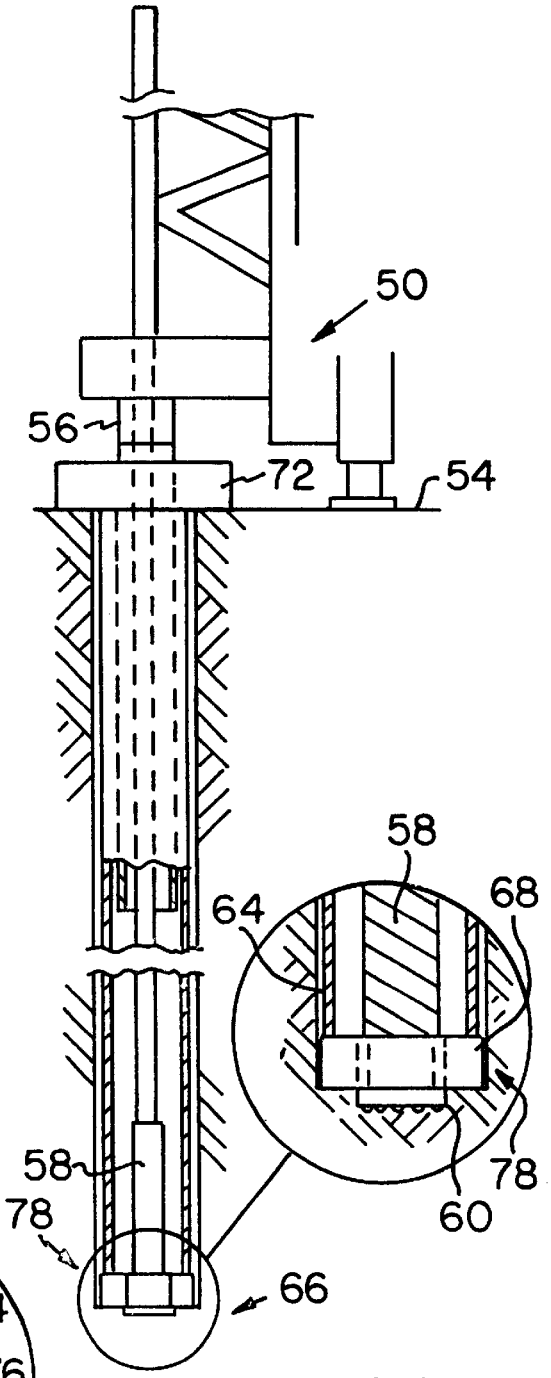

Next, the drilling machine 62 lowers the drill rod 56 and drill hammer 58 through the first inner conduit first end 74. Since the drill bit 60 is attached to the end of the drill hammer 58, the drill bit 60 is also lowered through the first inner conduit 70 and towards the outer conduit drill end 66. When the drill bit 60 reaches the ring drill bit 68, it is engaged therewith, thereby creating a unitary drill bit head 78. See FIG. 5(*a*). FIG. 5(*b*) shows a preferred engagement arrangement between the drill bit 60 and the ring drill bit 68. In this preferred arrangement, the drill bit 60 has a tubular shape, with two locking recesses 80 circumferentially and oppositely spaced from each other. The ring drill bit 68 has two locking tabs 82 extending from an inner surface of the ring drill bit 68 and configured to mate with the locking recesses 80. Once the locking tabs 82 are engaged with the locking recesses 80, the drill bit 60 and the ring drill bit 68 are able to rotate simultaneously using the driving force that the drilling machine 62 imparts on the drill bit 60. The ring drill bit 68 typically includes a carbide insert for cutting. In addition, the drill bit 60 typically includes at least one air flow orifice 83 for forcing air through the drill bit 60 to the cutting area, and a cuttings flow orifice 84 for receiving and passing cuttings up to the surface 54. The cuttings flow orifice 84 may be in the form of a gap between the ring drill bit 68 and the drill bit 60. The drilling cuttings or shavings would flow up through the cuttings flow orifice 84, further through the first inner conduit 70 and up to the surface 54.

The drill bit 60 can be any size and shape, and constructed from any material, as long as it is able to be appropriately engaged with the ring drill bit 68, if required. For example, the drill bit 60 may be a pilot bit. The drill bit 60 used to drill the initial outer bore 52 section is typically sized and shaped differently than the drill bit 60 that engages the ring drill bit 68.

Figure 6:
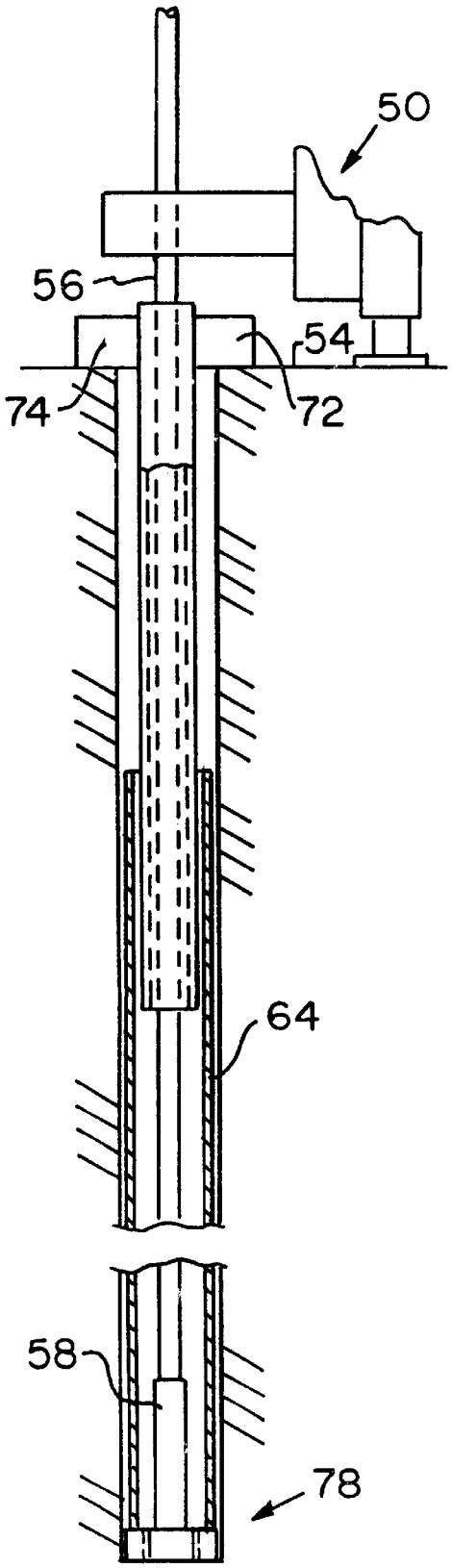
FIG. 6 is a side schematic sectional view of the drilling apparatus of FIG. 2 performing a further step of a preferred embodiment of the telescopic drilling method according to the present invention.
Figure 7:
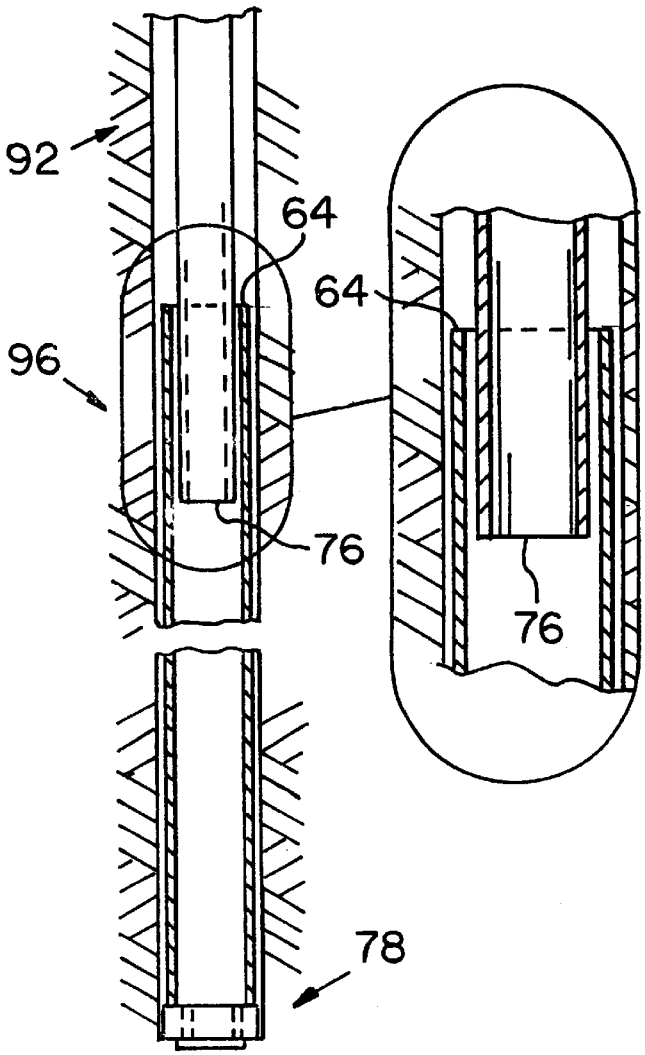
FIG. 7 is a side schematic sectional view of the drilling apparatus of FIG. 2 performing a further step of a preferred embodiment of the telescopic drilling method according to the present invention.

As seen in FIG. 6, as the unitary drill bit head 78 continues drilling a deeper outer bore 52, the outer conduit 64 is pulled downward with the unitary drill bit head 78. After the outer bore 52 has been drilled to an appropriate depth using the unitary drill bit head 78, the drill bit 60 is disengaged from the ring drill bit 68, and the outer conduit 64 is capable of moving freely and longitudinally within the outer bore 52. See FIG. 7

Next, in a preferred embodiment, a second inner conduit 86 having a second inner conduit first end 88 and a second inner conduit second end 90, is attached to the first inner conduit 70. Specifically, the second inner conduit second end 90 is attached to the first inner conduit first end 74, thereby creating an extended inner conduit 92. Typical methods of attachment are envisioned, such as welding the second inner conduit 86 to the first inner conduit 70.

After attachment, the first inner conduit 70 is released by the clamping mechanism 72, and the extended inner conduit 92 is extended further through the outer bore 52 and through the outer conduit 64. Preferably the drill rod 56, drill hammer 58 and drill bit 60 are removed from the first inner conduit 70 prior to attaching the first inner conduit 70 and the second inner conduit 86.

Figure 8:
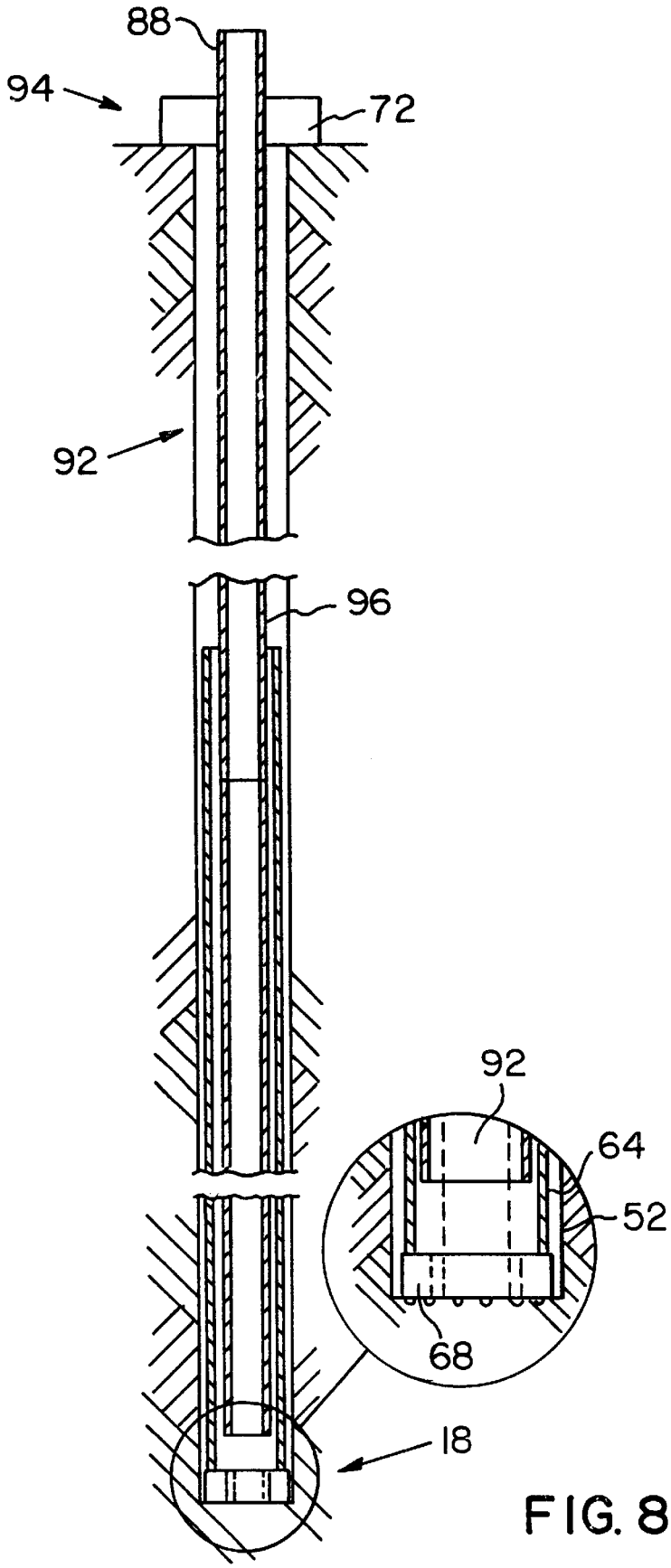
FIG. 8 is a side schematic sectional view of the drilling apparatus of FIG. 2 performing a further step of a preferred embodiment of the telescopic drilling method according to the present invention.

As with the first inner conduit 70, the extended inner conduit 92, having an extended inner conduit first end 94 and an extended inner conduit second end 96, is partially exposed at or near the surface 54. Specifically, the extended inner conduit first end 94 is clamped, using the clamping mechanism 72, in a workable position above the surface 54, while the extended inner conduit second end 96 extends to within the outer conduit 64, near the outer conduit drill end 66. The relative placement of the extended inner conduit 92, with respect to the outer bore 52 and the outer conduit 64 is illustrated in FIG. 8.

Next, the drill rod 56, drill hammer 58 and drill bit 60 are lowered through the extended inner conduit 92, and the drill bit 60 is engaged with the ring drill bit 68. As the outer bore 52 continues to deepen, additional drill rods 56 are attached or mated together using techniques and apparatus that are well known in the art. Drilling continues and the extended inner conduit 92 is lengthened using the above-described method until an underground layer 98 is encountered. This underground layer 98 may be bedrock, shale, clay or some other overburden material. At this point, drilling operations are terminated.

After this underground layer 98 is encountered, again the drill rod 56, drill hammer 58 and drill bit 60 (as disengaged from the ring drill bit 68) are removed from the extended inner conduit 92. An inner bore drill bit 100 is attached to the drill hammer 58, and this inner bore drill bit 100 has an outside diameter, which is smaller than the inside diameter of the ring drill bit 68. Therefore, the inner bore drill bit 100 is able to pass through the ring drill bit 68.

Figure 9:
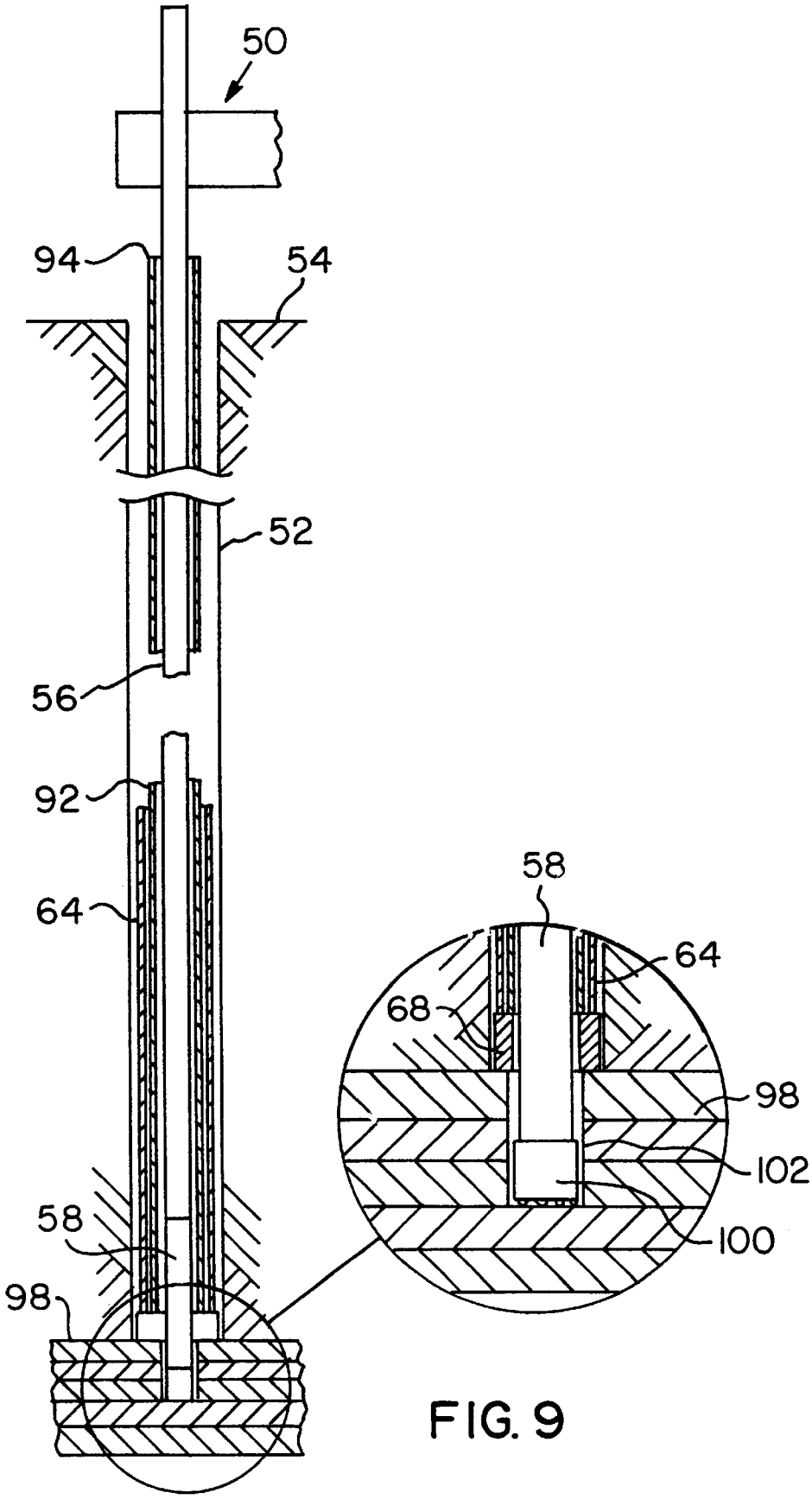
FIG. 9 is a side schematic sectional view with certain portions removed of the drilling apparatus of FIG. 2 performing a further step of a preferred embodiment of the telescopic drilling method according to the present invention.

As shown in FIG. 9, the drill rod 56 and drill hammer 58, with the inner bore drill bit 100 attached, are lowered through the extended inner conduit 92, pass through the ring drill bit 68 and are utilized to drill an inner bore 102. While the inner bore drill bit 100 penetrates the underground layer 98, creating the inner bore 102, the outer conduit drill end 66 rests on an upper surface of the underground layer 98. In addition, the extended inner conduit 92 is sized such that the extended inner conduit second end 96 rests on the ring drill bit 68.

Figure 10:
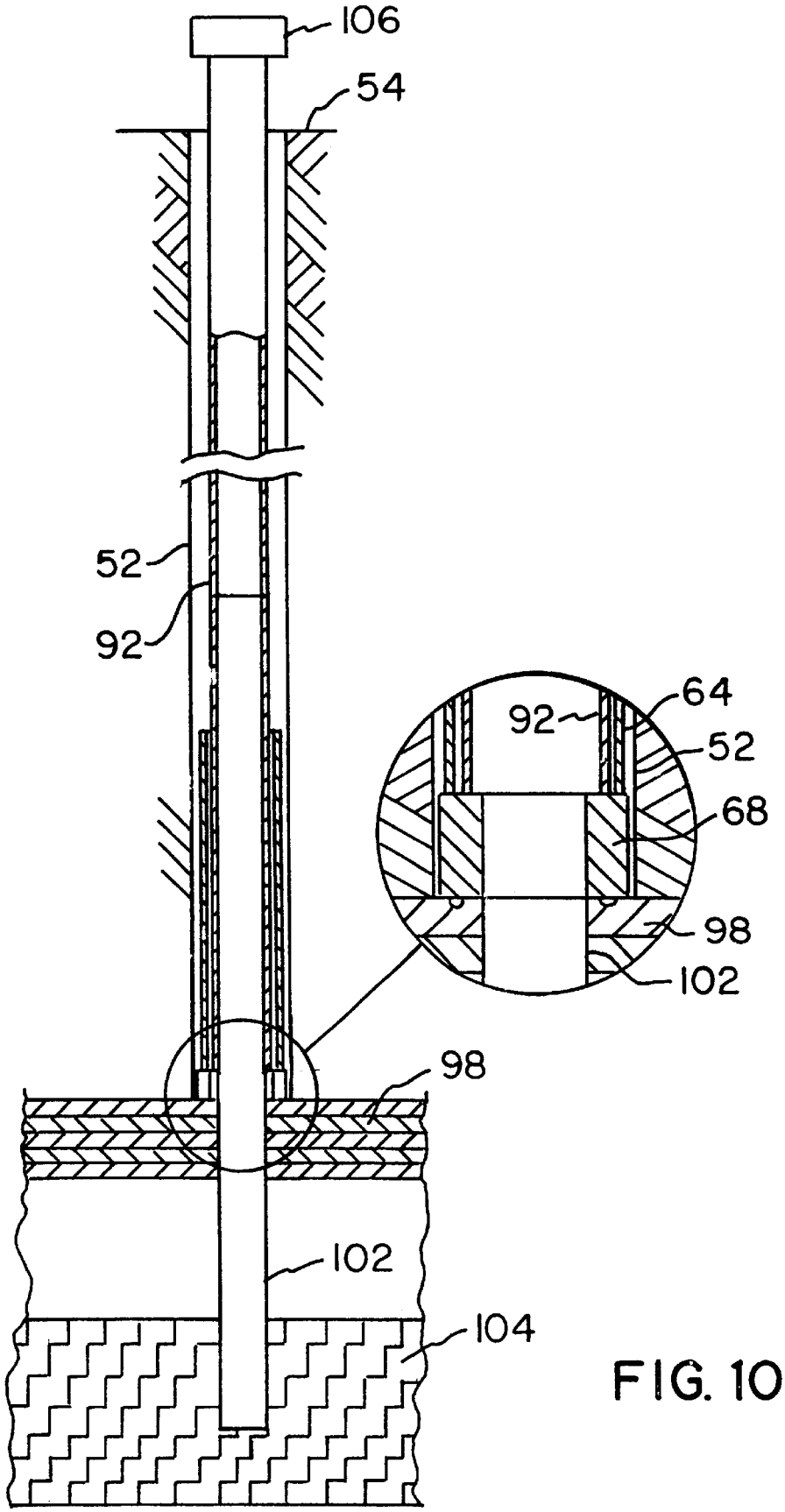
FIG. 10 is side schematic sectional view of the drilling apparatus of FIG. 2 performing a further step of a preferred embodiment of the telescopic drilling method according to the present invention.

Drilling operations continue, and the inner bore 102 deepens until a second underground layer 104 is encountered. This second underground layer 104 is typically an underground aquifer or a water layer. At this point, the drill rod 56, drill hammer 58 and inner bore drill bit 100 are removed from the inner bore 102 and the outer bore 52. The inner bore 102 now provides access to the aquifer layer or successive underground layer 104, and the water is able to pass up through the inner bore 102, through the ring drill bit 68, and further up through the extended inner conduit 92 to the surface 54. When the successive underground layer 104 is encountered, the extended inner conduit first end 94 is sealed with a cap 106. This arrangement is shown in FIG. 10.

Typically, the first inner conduit 70, second inner conduit 86, and any other successive sections which form the extended inner conduit 92 all have a uniform inside diameter and are provided with an appropriate seal such that water can flow up through the extended inner conduit 92 to the surface 54.

EXAMPLE

In a specific example of the telescopic drilling method of the present invention, the outer bore 52 has a ten inch diameter, and an initial depth of twenty-five feet. The drill bit is a ten and one-eigth inch diameter bit. The outer conduit 64, with the ring drill bit 68 attached, has a length of twenty-five feet four inches. The ring drill bit 68 has a seven and one-half inch diameter.

The first inner conduit 70, second inner conduit 86 and, therefore, the extended inner conduit 92, have a six and five-eighths inch diameter. As the outer bore 52 deepens to a depth of about forty feet four inches, the outer conduit 64 overlaps the first inner conduit 70 by at least four feet. This ensures that the first inner conduit 70 does not exit and misalign with the outer conduit 64. The clamping mechanism 72 holds the second inner conduit first end 88 and/or the extended inner conduit first end 94 approximately one foot above the surface 54. After the first inner conduit 70 and second inner conduit 86 have been attached, there is approximately twenty-four feet of overlap between the extended inner conduit 92 and the outer conduit 64. As the unitary drill bit head 78 continues drilling, the outer conduit 64 may have a diameter of seven and one-fourth inch.

The unitary drill bit head 78 continues drilling and when the extended inner conduit first end 94 is approximately one foot above the surface 54, the outer bore 52 is now at a depth of approximately sixty feet four inches. This method continues until bedrock is encountered, which, in this example, is at eighty feet four inches. In order to drill through the first underground layer 98, namely bedrock, the drill hammer 58 is fitted with a five and one-eighth inch drill bit 60, and drilling continues until the second underground layer 104 is encountered.

The telescopic drilling method of the present invention utilizes a free or floating telescoping bit in the form of the outer conduit 64 attached to the ring drill bit 68. This relieves fracture-causing stress from the extended inner conduit 92 and its weld joints, which is typically experienced in known drilling methods. The outer conduit 64, with the ring drill bit 68 attached, absorbs substantial drilling impact and vibration stress, thereby alleviating stress cracks or fractures in the extended inner conduit 92, which eventually becomes the water well. Since a cracked or fractured casing or weld joint requires that the outer bore 52 be cleared and the drilling process halted for reparations, the telescopic drilling method of the present invention increases efficiencies and decreases material expense.

In addition to relieving impact and vibration stress from the extended inner conduit 92, the use of the telescopic drilling method of the present invention and free or floating outer conduit 64 and ring drill bit 68, the overall drilling system and process may continue at a more rapid pace. This increased speed is achieved since the unitary drill bit head 78 is not required to pull the extended inner conduit 92 along with it as it penetrates further into the earth. Instead, the unitary drill bit head 78 of the present invention must only pull, and in effect works with, the telescoping portion (outer conduit 64 and ring drill bit 68), and not with the extended inner conduit 92, which may be experiencing friction, pressure and contortions, as a result of the outer bore 52 walls collapsing and overburden filling-in against the extended inner conduit 92. With the present invention, successive inner conduit may simply be pushed along behind the unitary drill bit head 78 from above by the drilling machine 62. This, in turn, makes the telescopic drilling method of the present invention a more efficient drilling process and reduces "wear and tear" effects on the drilling apparatus 50.

The prior art drilling methods require that each successive, welded inner conduit or casing section remain above the surface 54 during the drilling process, whereas the telescopic drilling method of the present invention permits each successive inner conduit to be fully lowered into the outer bore 52 prior to recommencing drilling. The present invention is safer than the prior art drilling methods, as the next or successive inner conduit section does not need to be positioned unsafely overhead over the work site during the drilling process, and, further, the next segment of the drill rod 56 does not need to be loaded within the next drill rod 56 section before it is transported and directed above the outer bore 54 for welding to the preceding section. The transport of the next inner conduit section or segment containing the next segment of the drill rod 56 to a position above the outer bore 52 is both precarious and has resulted in human injury. The method of the present invention permits the next segment of the drill rod 56 to be positioned only after the next inner conduit section is lowered into the outer bore 52.

Known current drilling methods also require that the drilling byproduct or shavings be expelled and managed high above the surface 54, and these methods require the use of a cap 30 or converter system, which caps the top of the next casing section 18 as it moves toward surface 54 level during the drilling process. Both the cap 30 and the tube 32 must be removed and replaced for each drilling segment. The method of the present invention allows drilling byproduct to be expelled, managed and collected immediately above the outer bore 52 at the surface 54 and negates the use of an unwieldy converter system towering above. Therefore, the method of the present invention alleviates an overhead hazard, the possibility that the tube 32 may entangle a person or machinery, and eliminates certain steps, thereby reducing complexity, the opportunity for further harm and unnecessary delays in the drilling process.

This invention has been described with reference to the preferred embodiments. Obvious modifications and alterations will occur to others upon reading and understanding the preceding detailed description. It is intended that the invention be constructed as including all such modifications and alterations.

I claim:

1. A telescopic drilling method, comprising the steps of:

(a) drilling an outer bore through a surface, the outer bore defined by an outer bore wall and an outer bore base and having an outer bore diameter and a first outer bore depth;

(b) inserting a hollow outer conduit into the outer bore, the outer conduit having a drill end with a ring drill bit rotatably attached thereto;

(c) at least partially inserting a first hollow inner conduit through the outer conduit;

(d) preventing the first inner conduit from moving longitudinally with respect to the outer conduit;

(e) engaging a rotatable inner drill bit with the ring drill bit, thereby creating a unitary drill bit head;

(f) further drilling the outer bore using the unitary drill bit head to a successive outer bore depth;

(g) disengaging the inner drill bit from the ring drill bit, such that the outer conduit is capable of moving freely within the outer bore;

(h) attaching a second end of a successive hollow inner conduit to a first end of an immediately preceding inner conduit, thereby creating an extended inner conduit;

(i) unclamping the preceding inner conduit; and (j) repeating steps (c)–(g) utilizing the extended inner conduit.

2. The telescopic drilling method of claim 1, wherein the extended inner conduit has a uniform inside diameter.

3. The telescopic drilling method of claim 1, further comprising the step of drilling an inner bore through the base of the outer bore, the inner bore defined by an inner bore wall and an inner bore base and having an inner bore diameter smaller than the outer bore diameter.

4. The telescopic drilling method of claim 3, further comprising the step of inserting an inner bore drill bit through the inner conduit and ring bit, the inner bore drill bit having an outside diameter smaller than an inside diameter of the ring bit.

5. The telescopic drilling method of claim 3, wherein the outer bore terminates at an upper surface of an underground layer.

6. The telescopic drilling method of claim 5, wherein the underground layer is one of bedrock, shale and clay.

7. The telescopic method of claim 6, wherein the ring drill bit rests upon the upper surface of the underground layer.

8. The telescopic drilling method of claim 3, wherein the inner bore terminates within a second underground layer.

9. The telescopic drilling method of claim 8, wherein the second underground layer comprises water.

10. The telescopic drilling method of claim 3, wherein the inner bore is drilled using a drilling apparatus having a rotatable drill rod with a drill end having a rotatable drill hammer attached thereto.

11. The telescopic drilling method of claim 10, further comprising the step of attaching an inner bore drill bit to the rotatable hammer.

12. The telescopic drilling method of claim 3, further comprising the step of removing cuttings from the inner bore via the inner conduit at an outer bore surface end.

13. The telescopic drill method of claim 1, wherein the ring bit has a ring bit upper ledge, and the inner conduit has an inside diameter equal to or greater than an inside diameter of the ring bit upper ledge, whereby the inner conduit is capable of resting upon the ring bit upper ledge.

14. The telescopic method of claim 1, further comprising the step of capping a first end of an exposed hollow inner conduit end.

15. The telescopic drilling method of claim 1, wherein the outer bore is drilled using a drilling apparatus having a rotatable drill rod with a drill end having a rotatable drill hammer attached thereto.

16. The telescopic drilling method of claim 15, further comprising the step of attaching the inner drill bit to the rotatable hammer.

17. The telescopic drilling method of claim 1, further comprising the step of removing cuttings from the outer bore at an outer bore surface end.

18. The telescopic drilling method of claim 1, wherein the inner drill bit and the ring drill bit are engaged via a locking mechanism.

19. The telescopic drilling method of claim 1, wherein the inner drill bit includes at least one locking recess and the ring drill bit includes a corresponding at least one locking tab configured to engage the at least one locking recess, whereby, when the at least one locking tab is engaged with the at least one locking recess, the inner drill bit and the ring drill bit are rotatable in unison.

20. A telescopic drilling method, comprising the steps of:

drilling an outer bore through a surface, the outer bore defined by an outer bore wall and an outer bore base and having an outer bore diameter and a first outer bore depth;

inserting a hollow outer conduit into the outer bore, the outer conduit having a drill end with a ring drill bit rotatably attached thereto;

at least partially inserting a first hollow inner conduit through the outer conduit;

preventing the first inner conduit from moving longitudinally with respect to the outer conduit;

engaging a rotatable inner drill bit with the ring drill bit, thereby creating a unitary drill bit head;

further drilling the outer bore using the unitary drill bit head to a successive outer bore depth;

disengaging the inner drill bit from the ring drill bit, such that the outer conduit is capable of moving freely within the outer bore; and drilling an inner bore through the base of the outer bore, the inner bore defined by an inner bore wall and an inner bore base and having an inner bore diameter smaller than the outer bore diameter, wherein the outer bore terminates at an upper surface of an underground layer, the inner bore terminates within a second underground layer and the second underground layer comprises water.

* * * * *

UNITED STATES PATENT AND TRADEMARK OFFICE

CERTIFICATE OF CORRECTION

PATENT NO. : 6,702,040 B1
DATED : March 9, 2004
INVENTOR(S) : Floyd R. Sensenig

It is certified that error appears in the above-identified patent and that said Letters Patent is hereby corrected as shown below:

Column 8,
Line 17, “claim 6” should read -- claim 5 --.
Line 19, “claim 3” should read -- claim 5 --.

Signed and Sealed this

Tenth Day of August, 2004

JON W. DUDAS
*Acting Director of the United States Patent and Trademark Office*